US005109160A

United States Patent [19]

Evers

[11] Patent Number: 5,109,160

[45] Date of Patent: Apr. 28, 1992

[54] STERILIZABLE RADIONUCLIDE GENERATOR AND METHOD FOR STERILIZING THE SAME

[75] Inventor: John H. Evers, Medway, Mass.

[73] Assignee: E. I. du Pont de Nemours and Company, Wilmington, Del.

[21] Appl. No.: 596,273

[22] Filed: Oct. 12, 1990

[51] Int. Cl.[5] ..... G21G 1/00; G21H 5/00

[52] U.S. Cl. ..... 250/432 PD

[58] Field of Search ..... 250/432 PD

[56] References Cited

U.S. PATENT DOCUMENTS

| | | | |
|---|---|---|---|
| 3,369,121 | 2/1968 | Bruno et al. | 250/106 |
| 3,440,423 | 4/1969 | Bruno et al. | 250/106 |
| 3,576,998 | 4/1971 | Deutsch et al. | 250/106 |
| 3,709,365 | 1/1973 | Czaplinski et al. | 210/233 |
| 3,774,035 | 11/1973 | Litt | 250/432 PD |
| 3,801,818 | 4/1974 | Hulit et al. | 250/432 PD |
| 3,920,995 | 11/1975 | Czaplinski et al. | 250/432 PD |
| 4,239,970 | 12/1980 | Eckhardt et al. | 250/432 PD |

*Primary Examiner*—Bruce C. Anderson

[57] ABSTRACT

A radionuclide generator of the type having a column with an inlet port and an outlet port, means for connecting the inlet port of the column to a source of eluant, and means for connecting the outlet port to an eluate collection vessel, further includes a plug removably mounted to the inlet connecting means to seal the same and a cover removably mounted to the outlet connecting means. The outlet cover has a vent therein whereby gases produced during the sterilization of the generator are vented.

8 Claims, 3 Drawing Sheets 60
58
20
18N
38
54
56
36
54A
56A
26N
52
16
14P
42
14P
10
44
46
44
12

STERILIZABLE RADIONUCLIDE GENERATOR AND METHOD FOR STERILIZING THE SAME

BACKGROUND OF THE INVENTION

1. Field of the Invention

The present invention relates to a sterilizable radionuclide generator and to a method for sterilizing the same.

2. Description of the Prior Art

U.S. Pat. No. 3,576,998 (Deutsch et al.) and U.S. Pat. No. 3,774,035 (Litt), both assigned to the assignee of the present invention, relate to the generation of daughter radionuclide from a relatively longer lived parent radionuclide. The radionuclide generator disclosed in each of these patents comprises a column containing a relatively long lived parent radionuclide. The long lived parent radionuclide is spontaneously decayable into a short lived daughter radionuclide. The column includes an inlet port and an outlet port that are respectively accessible through appropriate respective inlet and outlet connection means.

In use, the short lived daughter radionuclide is selectively removable from the column by passing an eluant liquid through the column. A container of eluant liquid is mounted to the inlet connection means while a receptacle, typically an evacuated vial, for receiving the resulting eluate is directly mounted to the outlet connection means. As the eluant passes through the column daughter radionuclide is drawn into the collection vial.

The manufacture of the radionuclide generator is performed under controlled conditions. The column outlet includes a bacterial retentive filter to assure the sterility of the generator eluate. It is believed possible to provide an even higher assurance of sterility through terminal sterilization.

Accordingly, it is believed advantageous to provide a structure for a radionuclide generator that is sterilizable, and to a method for sterilizing the generator during manufacture thereof.

SUMMARY OF THE INVENTION

The present invention relates to a radionuclide generator of the type having a column having a long lived parent radionuclide and a relatively short lived daughter radionuclide therein. The column has an inlet port and an outlet port with means provided for connecting the inlet port of the column to a source of eluant and means provided for connecting the outlet port of the column to an eluate collection vessel.

In accordance with the present invention a plug is removably mounted to the inlet connecting means to seal the same while a cover is removably mounted to the outlet connecting means. The cover has a vent therein. The vent in the cover permits gases produced during the sterilization of the generator to be vented therethrough. Moreover, the column medium serves as a trap to prevent the escape of the parent radionuclide from the column. A separate, self-sealing inlet tube may be connected to the inlet of the column for loading a parent radionuclide during charging of the column. In addition, a vent needle for venting the source of eluant when the same is connected to the inlet needle may also be provided.

In accordance with the method of the present invention, if the separate self-sealing inlet tube (and vent needle) is (are) provided, the inlet connection means of the column (and vent needle) is (are) sealed by the plug and the column is charged with a parent radionuclide.

Charging is effected by connecting the separate inlet tube to a source of parent radionuclide having a predetermined pressure therein while the outlet port of the column is connected to a region having a lower pressure therein. Alternatively, if the separate inlet tube is not provided, charging is effected by connecting the inlet connection means of the column to the source of parent radionuclide and by connecting the outlet port of the column to the lower pressure region.

Once charged, if not previously plugged, the inlet connection means of the column (and vent needle) is (are) sealed by the plug. In addition, the vented cover is disposed over the outlet connection means. The generator is then sterilized, as by the passing of saturated steam under pressure through the fluid pathways within the generator. Gases produced during sterilization are vented through the cover. Venting prevents radionuclide contamination during the sterilization process and allows the sterilization to be the final step of the generator manufacturing process. Therefore no additional manipulations are performed following sterilization which could potentially compromise the sterility of the generator. A bacterial retentive vent fiber disposed in the cover prevents microbial ingress and maintains sterility.

BRIEF DESCRIPTION OF THE DRAWINGS

The invention will be more fully understood from the following detailed description thereof, taken in connection with the accompanying drawings, which form a part of this application and in which.

DESCRIPTION OF THE INVENTION

Figure 1:
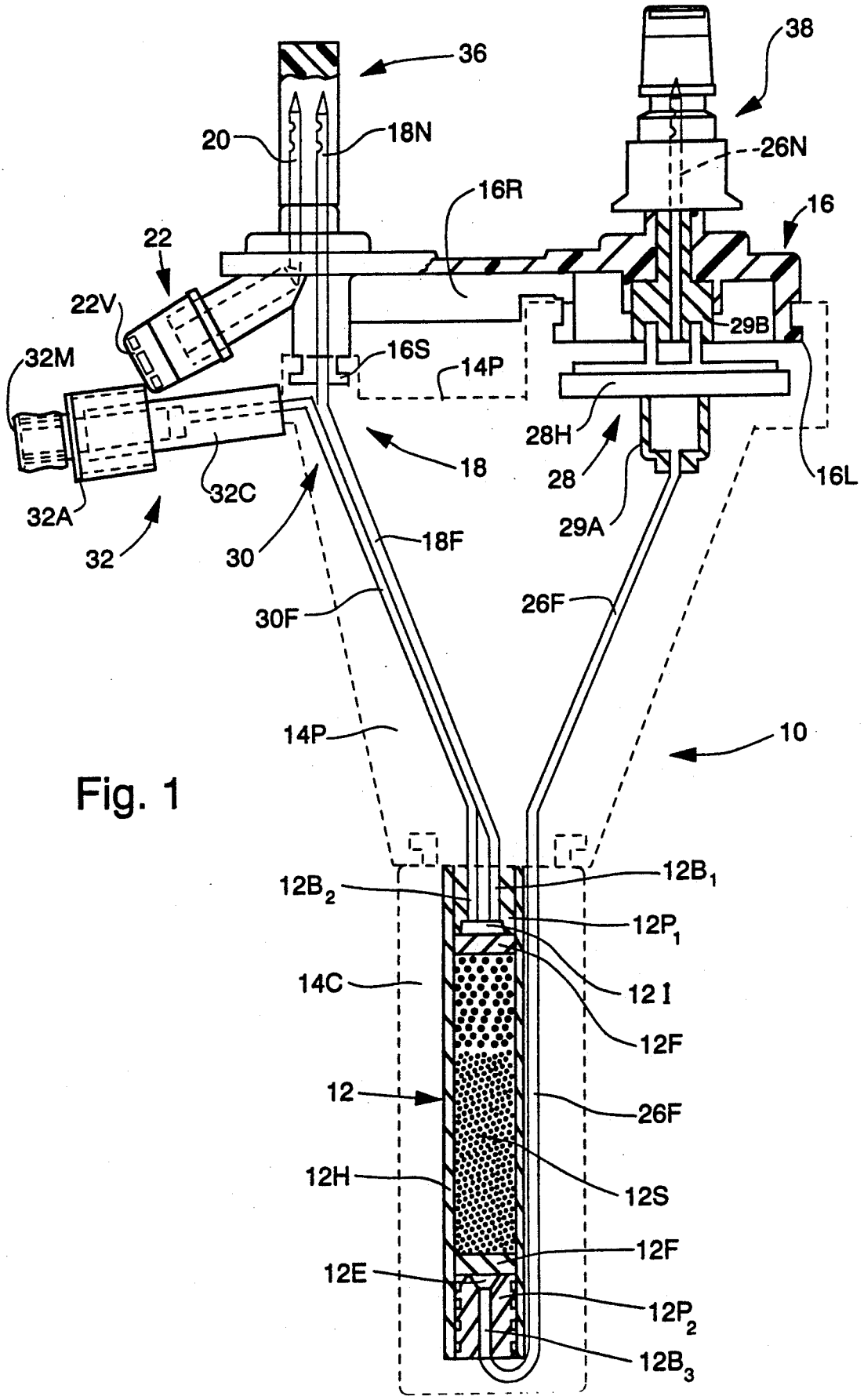
FIG. 1 is a side elevational view of a radionuclide generator in accordance with the present invention with portions thereof shown in section.

Throughout the following detailed description similar reference numerals refer to similar elements in all Figures of the drawings.

FIG. 1 illustrates a radionuclide generator generally indicated by the reference character 10 in accordance with the present invention. The radionuclide generator 10 includes a column 12 surrounded by a cylindrical lead shield 14C. Disposed above the shield of 12 is a frustoconical lead shielding plug 14P. The outline of the shield 14C and the plug 14P is indicated in FIG. 1 by dashed lines. The details of the structure and operation of the column 12 are fully disclosed in both U.S. Pat. No. 3,576,998 (Deutsch et al.) and U.S. Pat. No. 3,774,035 (Litt), each of which is assigned to the assignee of the present invention. Both of these patents are hereby incorporated by reference herein.

The column 12 is similar to that disclosed in the above-mentioned U.S. Pat. No. 3,774,035 (Litt), and thus needs to be only briefly discussed. The column 12 is formed of a cylindrical glass housing 12H. The housing is made liquid-tight by the provision of end plugs $12P_1$ and $12P_2$. The end plugs $12P_1$ and $12P_2$ are typically formed of an elastomeric material, such as silicone. In the preferred instance the end plug $12P_1$ has a pair of passages $12B_1$ and $12B_2$ extending therethrough. The passages $12B_1$ and $12B_2$ each open into a relatively enlarged region that defines the inlet port 12I of the column 12. The end plug $12P_2$ has a passage $12B_3$ extending therethrough. The passage $12B_3$ opens into a relatively enlarged region that defines the outlet port 12E of the column. Immediately adjacent to each of the plugs $12P_1$ and $12P_2$ is a layer of polyethylene frit 12F. Disposed on a substrate 12S mounted within the housing 12H of the column 12 is a parent radionuclide. The parent radionuclide is spontaneously decayable into a relatively short lived daughter radionuclide.

A support platform 16 having a central reinforcement 16R extending thereunder is secured at a large peripheral flange 16L and at a small peripheral flange 16S to the shielding plug 14P. The platform 16 is preferably molded from polycarbonate plastic material.

Inlet connection means 18 is provided for connecting the inlet port 12I of the column 12 to a source of eluant (not shown). In the preferred instance the inlet connection means 18 comprises an inlet flow line 18F and an associated inlet needle 18N with which it is in fluid communication. The inlet flow line 18F and the inlet needle 18N are typically fabricated from stainless steel tubing. The inlet flow line 18F extends through the plug 14P and the passage $12B_1$ in the plug $12P_1$ to its point of communication with the inlet port 12I of the column 12. The inlet needle 18N projects from the support platform 16.

A flow vent needle 20 is mounted on the support platform 16 in the vicinity of the inlet needle 18N. The flow vent needle 20 communicates with a cap 22 that depends from the undersurface of the platform 16. The cap 22 has a vent 22V formed therein.

Means 26 is provided for connecting the outlet port 12E of the column 12 to an eluate conneciton vessel (also not shown). The outlet connection means 26 includes an outlet flow line 26F (similar to the flow line 18F) and an outlet needle 26N. Both the outlet flow line 26F and the outlet needle 26N are fabricated from stainless steel tubing. The outlet needle 26N projects from the support platform 16. The outlet flow line 26F extends through the plug 14P, the cylindrical shield 14C and the passage $12B_3$ to the outlet port 12E of the column 12.

A filter arrangement generally indicated by the character 28 may be disposed in the outlet flow line 26F. The filter 28 includes a bacterial retentive filter element (itself not illustrated) that is housed within a polypropylene outer housing 28H. The housing is suggested in full outline. Suitable for use as the filter element is a 0.22 micrometer porous polytetrafluoroethylene (PTFE) membrane that is obtained from Millipore Corporation, Bedford, Mass.

One side of the filter housing 28H is connected to the outlet flow line 26F by a molded silicone connector 29A (shown in section). The opposite side of the housing 28H is connected to the outlet needle 26N by a molded polypropylene hub 29B (shown in section) that extends through the platform 16.

It should be understood that although the inlet connection means 18 and the outlet connection means 26 have been shown as a terminating in a needle 18N and 26N, respectively, any other form of convenient arrangement whereby the inlet and outlet ports of the column 12 are respectively connected to a source of eluant and to an eluate collection vessel lies within the contemplation of the present invention. For example, needle receiving fittings may be used to terminate the inlet and/or outlet connection means.

In the preferred instance means generally indicated by the reference character 30 connected to the inlet of the column, the means typically being in the form of a charging flow line 30F preferably fabricated from stainless steel, extends through the shielding plug 14P. The charging flow line 30F extends through the passage $12B_2$ in the end plug $12P_1$ to its point of communication with the inlet port 12I of the column 12. The charging flow line 30F is thus separate and isolated from fluid communication with the inlet flow line 18F. The means 30 includes a connector fitting 32 terminating the free end of the charging flow line 30F. The fitting 32 is provided with a polycarbonate adapter 32A having a self-sealing pierceable membrane 32M. A suitable adapter is available from Medex Incorporated, Hillard, Ohio, as model B1492. The fitting 32 is connected to the line 30F by a molded silicone inlet connector 32C.

In accordance with the present invention the generator 10 is provided with a plug 36 that is removably mounted to the inlet needle 18N of the inlet connection means 18. When so mounted the plug 36 serves to seal the inlet connection means 18 and thus to prevent fluid flow through the inlet port 12I of the column 12. Moreover, since in the preferred case the flow vent needle 20 is located proximate to the inlet needle 18N, the plug 36 also serves to seal the flow vent needle 20. The plug 36 preferably takes the form of a cylindrical member extruded from an elastomeric material, such as silicone.

Figure 2:
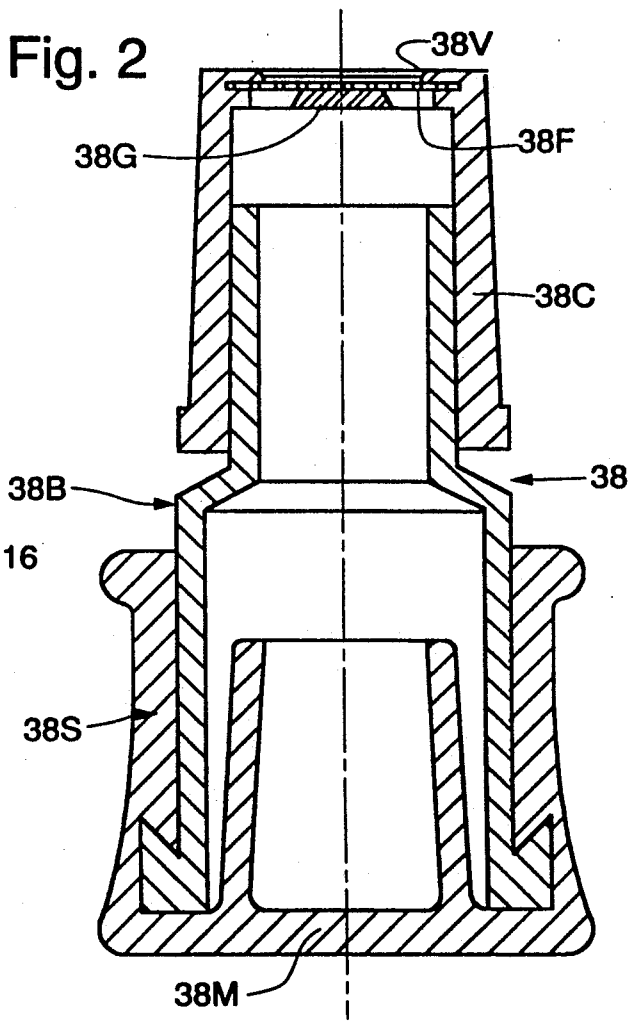
FIG. 2 is a side elevational view, in section, illustrating a cover for the outlet connection means of the radionuclide generator of FIG. 1.

Further, in accordance with the present invention a cover 38 is removably mounted to the outlet connecting means. The structure of the cover 38 is shown in more detail in FIG. 2. The cover 38 includes a generally hollow body member 38B formed from a molded polypropylene plastic material. The lower end of the body member 38B is affixed to a stopper sleeve 38S. The sleeve is closed by a pierceable membrane 38M. The sleeve 38S is fomred from an elastomeric material, such as silicone. A suitable sleeve is available from West Company, Phoenixville, Pa. as model 15. The upper end of the body member 38B receives a cap 38C having vent 38V therein. The cap 38C is fabricated from polypropylene and has an integral grid 38G that supports a 0.45 micrometer glass matrix bacterial retentive filter 38F thereon. A suitable cap is available from Burron Medical Incorporated, Bethlehem, Pa. as model S5002300. The vented cap 22 is similar to the vented cap 38 shown in FIG. 2.

Figure 3:
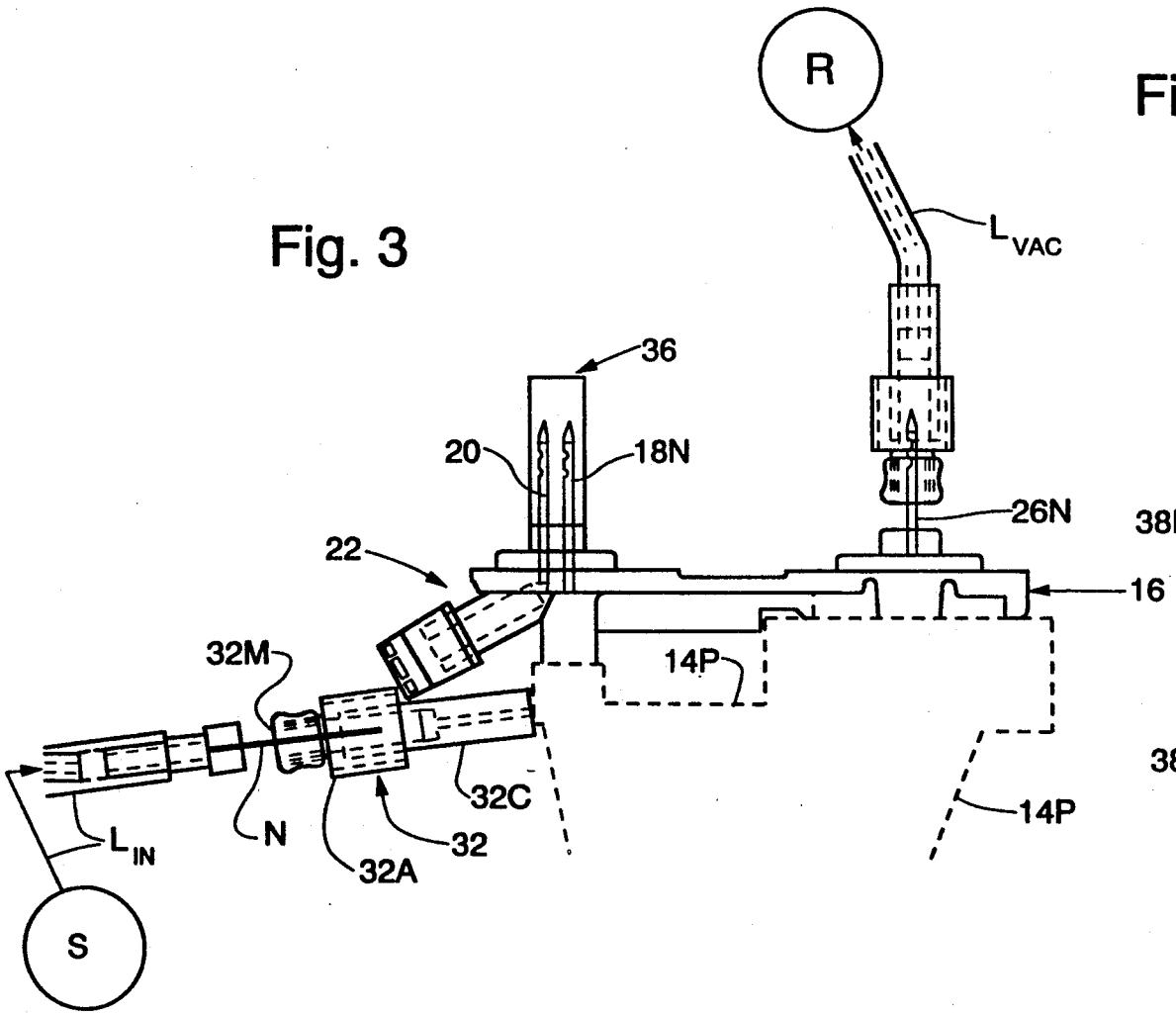
FIG. 3 is a diagrammatic view of the interconnection of a radionuclide generator of FIG. 1 with a source of a parent radionuclide and a lower pressure region while the generator is being charged with a parent radionuclide.

Having described the structure of the generator 10 in accordance with the present invention the operation thereof may now be discussed. Reference is invited to FIG. 3, which is a diagrammatic view of the interconnection of a radionuclide generator 10 as shown in FIG. 1 with a source of a parent radionuclide and a lower pressure region while the generator 10 is being charged with a parent radionuclide.

During loading of the radionuclide into the column 12 (and during the subsequent sterilization of the generator 10, as will be discussed) the inlet connection means 18 (specifically, the inlet needle 18N) and the vent flow needle 20 are sealed by the presence of the plug 36 thereon. A needle N coupled to an in-process loading line $L_{in}$ is inserted through the self-sealing pierceable membrane 32M of the connector fitting 32. The line $L_{in}$ communicates with a source of parent radionuclide, the same being indicated only diagrammatically by the reference character S. The source S is under a first predetermined pressure, typically atmospheric pressure.

The outlet connection mean 26 (specifically, the outlet needle 26N) is inserted into a self-sealing pierceable membrane M of a vacuum line connector C and thus placed in fluid communication with a vacuum line $L_{vac}$. The line $L_{vac}$ communicates with a region shown diagrammatically by the reference character R having a pressure less than the pressure within the parent souce S.

With the generator 10 connected to the source S and to the evacuated region R via the line $L_{in}$ and the line $L_{vac}$, respectively, and with the inlet needle 18N and the flow vent 20 sealed by the plug 36, parent radionuclide is drawn through the separate inlet flow line 30F into the column 12. In practice the column 12 of an individual generator or the column 12 in each of a plurality (e.g., on the order of one hundred or more) generators may be charged at one time.

An an alternative, if the separate charging glow line 30F is not provided, the column 12 may be charged using the inlet connection means 18, viz., the inlet needle 18N and its associated the inlet flow line 18F. Once charging is completed , the plug 36 is affixed to the needle 18N and the vent needle 20 (FIG. 1).

However charging is accomplished, once the column is charging the vacuum line $L_{vac}$ is removed from the outlet needle 26N and the cover 38 inserted thereon. Since the plug 36 is also in place the entire fluid path of the generator 10 may then be sterilized. Any suitable sterilization technique may be used, such as the application of saturated steam under pressure through the entire fluid path of the generator 10. The entire fluid path of the generator 10 includes the outlet connection means 26, the inlet connection means 18, the separate charging line 30F (if provided), and the column 12 itself.

Although the inlet port 12I of the column 12 is closed to the atmosphere by the self-sealing membrane 32M of the fitting 32 and by the plug 36 over the inlet needle 18N, the outlet port 12E of the column 12 is nevertheless open to atmosphere through the vent 38V of the outlet needle cover 38.

The hereinabove described structural arrangement of the generator 10 in accordance with the present invention, utilizing as it does the removable inlet plug 36 on the inlet connection means 18 and the vented outlet cover 38 on the outlet connection means 26, allows venting of the generator fluid path through the outlet cover 38. Venting of the fluid path permits the exchange of gases developed within the fluid path by the sterilizing medium (saturated steam) during the sterilization process. Further, the arrangement of the sealed inlet means and the vented outlet means directs the flow of gases and entrained particles developed within the generator fluid path during sterilization through the column 12. The column medium selectively traps residual parent radionuclide, preventing the escape of the same from the generator during sterilization, and thus, preventing any subsequent contamination of the external surfaces of the generator and surroundings.

It may be appreciated that utilizing a generator 10 having the structure in accordance with the present invention sterilization may be the final step of the generator manufacturing process in which the ports 12I, 12E of the column 12 are accessed. Therefore, no additional manipulations need be performed following sterilization which could potentially compromise the sterility of the generator 10. The bacterial retentive filter 38F, disposed in the outlet cover, prevents microbial ingress and thus maintains sterility of the generator 10.

Figure 4:
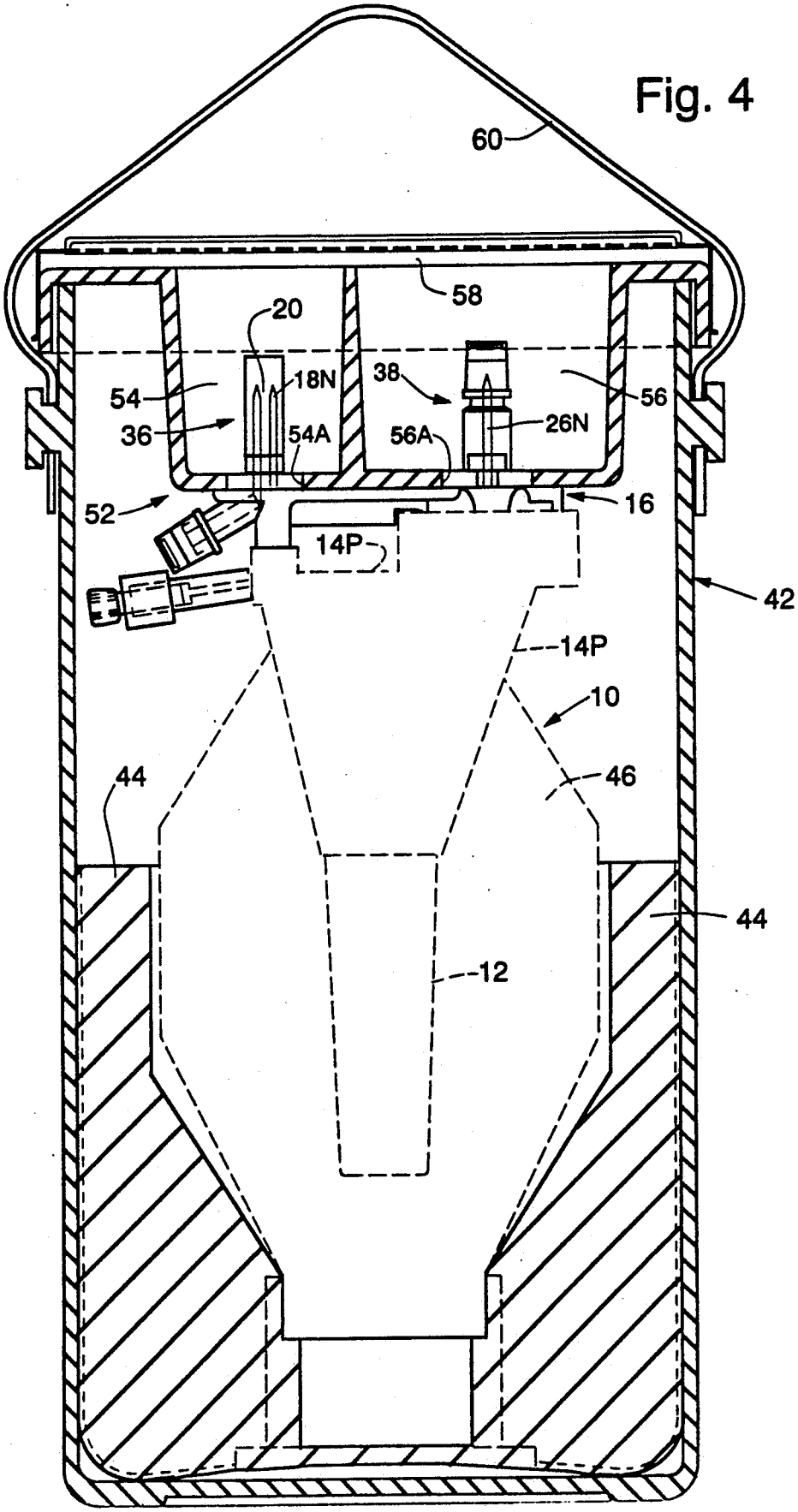
FIG. 4 is a side elevational view, in section, of a radionuclide generator as shown in FIG. 1 mounted in a cannister.

With reference now to FIG. 4, following sterilization the radionuclide generator 10 is inserted into a cannister 42. The cannister 42 includes a spacer 44 that supports a shielding lead base 46. The base 46 has a recess 48 shaped in correspondence with the outer configuration of the generator 10 and a portion of the plug 14P. A lid 52 having a charge well 54 and a collection well 56 formed therein is secured onto the open upper end of the cannister 42. The inlet needle 18N and the vent flow needle 20 (each still sealed by the plug 36) project into the chargw well 54 through an aperture 54A provided therein. Similarly, the outlet needle 26N (itself still covered by the cover 38) projects into the collection well 56 through an aperture 56A provided therein. A dust cover 58 is secured to the cannister 42. A carrying strap 60 may also be provided.

Prior to generating and collecting the radionuclide eluate from the sterilized generator by a user, the dust cover 58 is detached, and the cap 36 and the vented outlet needle cover 38 are removed. The generation and collection of a radionuclide eluate is thereafter effected as described fully in the hereinabove incorporated U.S. Pat. No. 3,774,035.

Those skilled in the art, having the benefit of the treachings of the present invention may effect numerous modifications thereto. Such modifications are, however, to be construed as lying within the scope of the present invention, as defined by the following claims.

What is claimed is:

1. In a radionuclide generator of the type having a column having a long-lived parent radionuclide and a relatively short-lived daughter radionuclide therein, the column having an inlet port and an outlet port, means for connecting the inlet port of the column to a source of eluant, and means for connecting the outlet port to an eluate collection vessel, the improvement which comprises:

a plug removably mounted to the inlet connecting means to seal the same; and, a cover removably mounted to the outlet connecting means, the cover having a vent and a filter disposed therein downstream of the outlet connection means whereby gases produced during the sterilization of the generator are vented through the cover.

2. The radionuclide generator of claim 1 further comprising means connected to the inlet port of the column for charging the same with a parent radionuclide, the charging means being separate from the inlet connecting means.

3. The radionuclide generator of claim 1 further comprising a flow vent for venting the source of eluant when the same is connected to the inlet connecting means, the plug also being removably mounted to the flow vent to seal the same.

4. In a radionuclide generator of the type having a column having a long-lived parent radionuclide and a relatively short-lived daughter radionuclide therein, the column having an inlet port and an outlet port, an inlet flow line terminating in an inlet needle for connecting the inlet port of the column to a source of eluant, and an outlet flow line terminating in an outlet needle for connecting the outlet port to an eluate collection vessel, the improvement which comprises:

a plug removably mounted to the inlet needle to seal the same; and, a cover removably mounted to the outlet needle, the cover having an elastomeric portion that engages the outlet needle, the cover also having a cap portion having a vent and a filter disposed therein, the filter being disposed downstream of the outlet connection means, such that gases produced during the sterilization of the generator are vented through the cover.

5. The radionuclide generator of claim 4 further comprising a charging flow line separate from the inlet flow line, the charging flow line being connected to the inlet port of the column for charging the same with a parent radionuclide.

6. The radionuclide generator of claim 4 further comprising a vent needle for venting the source of eluant when the same is connected to the inlet needle, the plug also being removably mounted to the vent needle to seal the same.

7. A method of manufacturing a radionuclide generator of the type having a column having an inlet port and an outlet port, the inlet port having both inlet connection means and a separate inlet flow line connected thereto while the outlet port has outlet connection means connected thereto, the method comprising the steps of:

(a) plugging the inlet connections with a removable plug to seal the same; and, (b) charging the column with a long-lived parent radionuclide spontaneously decayable into a relatively short-lived daughter radionuclide by connecting the inlet port of the column to a source of the parent radionuclide at a first pressure through the separate inlet flow line and by simultaneously connecting the outlet port of the column through the outlet connection means to a region having a second, lower, pressure;

(c) thereafter covering the outlet connection means with a removable cover having a vent and a filter disposed therein downstream of the outlet connection means, and (d) sterilizing the generator, any gases produced during sterilization being ventable throught the vent in the cover.

8. A method of manufacturing a radionuclide generator of the type having a column having an inlet port and outlet port, the inlet port having both inlet connection means while the outlet port has outlet connection means connected thereto, the method comprising the steps of:

(a) charging the column with a long lived parent radionuclide spontaneously decayable into a relatively short lived daughter radionuclide by connecting the inlet port of the column to a source of the parent radionuclide at a first pressure and by connecting the outlet port of the column to a region having a second, lower, pressure;

(b) plugging the inlet connections with a removable plug to seal the same;

(c) covering the outlet connection means with a removable cover having a vent and a filter disposed therein downstream of the outlet connection means, and, (d) sterilizing the generator, any gases produced during sterilization being ventable thorugh the vent in the cover.

* * * * *